US011365549B2

(12) United States Patent
Naeyaert et al.

(10) Patent No.: US 11,365,549 B2
(45) Date of Patent: Jun. 21, 2022

(54) FINISHING PROFILE AND FINISHING SET FOR A FLOOR COVERING, AND CUTTING TOOL FOR CUTTING SAID FINISHING PROFILE

(71) Applicant: FLOORING INDUSTRIES LIMITED, SARL, Bertrange (LU)

(72) Inventors: Christophe Naeyaert, Jabbeke (BE); Ewan Demaegdt, Assebroek (BE); Jonas Deman, Ghent (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 238 days.

(21) Appl. No.: 16/256,528

(22) Filed: Jan. 24, 2019

(65) Prior Publication Data

US 2019/0234080 A1 Aug. 1, 2019

Related U.S. Application Data

(60) Provisional application No. 62/724,991, filed on Aug. 30, 2018, provisional application No. 62/622,537, filed on Jan. 26, 2018.

(30) Foreign Application Priority Data

Jul. 2, 2018 (BE) ..... 2018/5457

(51) Int. Cl.
*E04F 15/02* (2006.01)
*E04F 19/06* (2006.01)
(Continued)

(52) U.S. Cl.
CPC ..... *E04F 19/062* (2013.01); *E04F 15/024* (2013.01); *E04F 15/02005* (2013.01);
(Continued)

(58) Field of Classification Search
CPC ..... E04F 15/02005; E04F 15/02022; E04F 19/02; E04F 19/04; E04F 19/061;
(Continued)

(56) References Cited

U.S. PATENT DOCUMENTS 5,657,598 A * 8/1997 Wilbs ..... E04F 19/063 52/287.1
6,047,506 A * 4/2000 Kemper ..... E04F 19/066 52/716.8
(Continued)

FOREIGN PATENT DOCUMENTS

BE 1 018 494 2/2011
BE 1 019 657 A3 9/2012
(Continued)

OTHER PUBLICATIONS

Partial European Search Report for Application No. 19152480.0 dated Jul. 8, 2019.
(Continued)

*Primary Examiner* — Ryan D Kwiecinski
(74) *Attorney, Agent, or Firm* — Jenkins, Wilson, Taylor & Hunt, P.A.

(57) ABSTRACT

A finishing profile for a floor covering, including at least a flange-shaped portion, which extends on opposite sides of an attachment portion situated on the underside, wherein the flange-shaped portion is formed in one piece from synthetics and is provided for being subdivided at the location of the attachment portion. The invention further also relates to a cutting tool for cutting up such finishing profile for a floor covering, wherein this cutting tool includes a body and includes at least one knife, wherein the position of the knife is adjustable.

22 Claims, 5 Drawing Sheets

(51) Int. Cl.
*E04F 21/00* (2006.01)
*E04F 15/024* (2006.01)

(52) U.S. Cl.
CPC ..... *E04F 19/061* (2013.01); *E04F 19/065* (2013.01); *E04F 19/067* (2013.01); *E04F 21/0076* (2013.01); *E04F 15/02155* (2013.01); *E04F 2201/03* (2013.01)

(58) Field of Classification Search
CPC ..... E04F 19/062; E04F 19/063; E04F 19/065; E04F 19/066; E04F 19/067; E04F 2019/0422; E04F 2019/0427; E04F 2019/0454; E04F 15/02155; E04F 21/0076; E04F 2201/03
USPC ..... 52/459, 464, 466, 468; D25/136
See application file for complete search history.

(56) References Cited

U.S. PATENT DOCUMENTS

| | | | | |
|---|---|---|---|---|
| 6,345,480 | B1 * | 2/2002 | Kemper | E04F 19/067 52/717.03 |
| 7,207,143 | B2 * | 4/2007 | Stanchfield | E04F 19/061 52/312 |
| 7,828,921 | B2 * | 11/2010 | Neuhofer | E04F 19/065 156/211 |
| 8,109,059 | B2 | 2/2012 | Proot | |
| 8,122,665 | B2 * | 2/2012 | Stanchfield | E04F 19/065 52/468 |
| 8,161,708 | B2 * | 4/2012 | Schacht | E04F 19/066 52/312 |
| 8,186,118 | B2 * | 5/2012 | Neuhofer | E04F 19/065 52/312 |
| 8,245,474 | B2 * | 8/2012 | Schacht | E04F 19/061 52/468 |
| 8,528,285 | B2 * | 9/2013 | Kornfalt | E04F 19/065 52/464 |
| 8,572,912 | B2 * | 11/2013 | Neuhofer, Jr. | E04F 19/068 52/211 |
| 8,572,919 | B1 * | 11/2013 | Neill | A47G 27/045 52/718.01 |
| 8,966,847 | B2 * | 3/2015 | Kessler | E04B 1/6804 52/396.04 |
| D743,052 | S * | 11/2015 | Glenn | D25/69 |
| 2006/0150565 | A1 * | 7/2006 | Schacht | E04F 19/062 52/716.1 |
| 2007/0193172 | A1 * | 8/2007 | Stanchfield | E04F 19/061 52/470 |
| 2007/0283654 | A1 * | 12/2007 | Stanchfield | E04F 19/061 52/749.1 |
| 2008/0263983 | A1 * | 10/2008 | Stanchfield | E04F 11/166 52/459 |
| 2009/0084065 | A1 * | 4/2009 | Neuhofer | E04F 19/062 52/745.19 |
| 2009/0266021 | A1 * | 10/2009 | Neuhofer, Jr. | E04F 19/061 52/468 |
| 2019/0234080 | A1 * | 8/2019 | Naeyaert | E04F 15/024 |

FOREIGN PATENT DOCUMENTS

| | | | | |
|---|---|---|---|---|
| BE | 1019657 | A3 * | 9/2012 | E04F 19/061 |
| DE | 202005020345 | U1 * | 3/2006 | A47G 27/045 |
| EP | 1 836 363 | B1 | 7/2011 | |
| EP | 1 841 573 | B1 | 3/2015 | |
| FR | 2873140 | A1 * | 1/2006 | E04F 19/061 |
| WO | WO 2006/074824 | A2 | 7/2006 | |
| WO | WO-2006093866 | A2 * | 9/2006 | E04D 1/365 |
| WO | WO-2006110934 | A2 * | 10/2006 | E04F 19/062 |
| WO | WO 2007/118999 | | 10/2007 | |
| WO | WO-2019018865 | A1 * | 1/2019 | A47G 27/045 |

OTHER PUBLICATIONS

European Search Report for Application No. 19152480.0 dated Oct. 14, 2019.

* cited by examiner

FINISHING PROFILE AND FINISHING SET FOR A FLOOR COVERING, AND CUTTING TOOL FOR CUTTING SAID FINISHING PROFILE

CROSS-REFERENCE TO RELATED APPLICATION

This application claims the benefit of and priority under 35 U.S.C. 119(e) to the U.S. provisional applications U.S. 62/622,537 filed on Jan. 26, 2018 and U.S. 62/724,991 filed on Aug. 30, 2018. This application also claims the benefit of and priority under 35 U.S.C. 120 to Belgian patent application BE 2018/5457 filed on Jul. 2, 2018.

TECHNICAL FIELD

This invention relates to a finishing profile for a floor covering, as well as to a finishing set and a cutting tool for cutting such finishing profiles. More particularly, the invention relates to a finishing set with at least one holder and at least one finishing profile attachable to said holder, and an associated cutting tool.

BACKGROUND

In particular, the invention is intended for being applied in combination with floor panels which are composed of a plurality of panels or strips. Herein, this may relate to floatingly installed floor coverings as well as to floor coverings glued flat onto the underlying surface and consisting, for example, of a plurality of laminate panels, panels for ready-to-lay parquet, veneer parquet or solid parquet, plastic-based floor panels, such as vinyl panels of the type LVT (Luxury Vinyl Tile), rigid LVT, WPC (Wood or Waterproof Plastic Composite) or SPC (Stone Plastic Composite), panels of compact laminate and the like. However, this does not exclude that it can also be applied in combination with other floor coverings.

When installing floor coverings, as with floatingly installed floor coverings, too, in a large number of cases measures have to be taken for finishing the edges thereof. Such edges which have to be additionally finished may be found at the end of the floor covering, for example, against a wall, at a transition to another type of floor covering, or when providing an expansion joint between two floor coverings, which may or may not be of a different kind, by which is meant, amongst others, of a different material or of a different thickness.

It is known that to this aim, use can be made of a finishing set, which, as aforementioned, mostly consists of at least one holder and at least one finishing profile attachable to said holder, wherein the finishing profile allows that the respective edge or transition hereby is covered and in this manner in most cases also forms an esthetic transition.

Herein, the holder mostly consists of or comprises a rail-shaped profile, which preferably can be attached to the underlying surface, for example, by gluing, screwing, nailing, or simply by installing this profile partially underneath the floor covering. The holder mostly also comprises an attachment portion for attaching a finishing profile onto the holder. The holder may extend continuously or interruptedly underneath the finishing profile.

The finishing profile usually is realized as a, whether or not multi-piece, decorative strip or the like, which can be fixedly pressed in the rail-shaped profile. Further, it is known that such finishing profile can be finishing profile can be realized in the form of an end profile, transition profile, as well as an expansion profile or a combination thereof. End profiles mostly serve for finishing against a wall, transition profiles for the transition from one type of floor covering to another type, and expansion profiles for bridging an expansion joint between two portions of a floor covering.

Such finishing sets and the component parts thereof are known, amongst others, from EP 1 836 363 and EP 1 841 573. The finishing profile of EP'363 is multi-functional and allows forming various transition profiles for floor coverings, such as expansion profiles, end profiles, transition profiles and skirting boards, by removing two or more of the aforementioned parts from each other or combining them with each other. From EP'363, finishing profiles are known which, apart from a flange-shaped portion which extends on opposite sides of an attachment portion situated on the underside, also comprise at least one nose portion, wherein this at least one nose portion is situated to the left and/or right of the attachment portion and on the underside of said flange-shaped portion. The aforementioned attachment portion serves for positioning the finishing profile in the holder. One or both nose portions of the finishing profile known from EP'363 can be removed in function of the application of the finishing profile by breaking, tearing, cutting, and the like.

SUMMARY

The invention primarily aims at an alternative finishing profile and an alternative finishing set of the aforementioned type, wherein according to various preferred embodiments a solution can be obtained for the problems with the finishing profiles and finishing sets from the state of the art.

To this aim the invention, according to its first independent aspect, relates to a finishing profile for a floor covering, wherein this profile comprises at least a flange-shaped portion, which extends on opposite sides of an attachment portion situated at the underside, with the characteristic that the flange-shaped portion is formed in one piece from synthetics and is provided for being subdivided at the location of the attachment portion.

The finishing profile and associated finishing set for a floor covering according to the first independent aspect of the invention offer additional usage possibilities for the finishing profile. When subdividing, the subdividing at the location of the attachment position can result in an attractive end profile. The embodiment in synthetics ensures sufficient mechanical strength, even with finishing profiles of which the flange-shaped portion is thin, for example, has a thickness of less than 5 mm.

As aforementioned, an end profile can be obtained by dividing or separating the finishing profile in two, wherein it is possible to use both halves as an end profile. It is clear that the dividing or separating of the different separable portions at the location of the attachment portion is not necessary in all applications of the finishing profile. So, for example, it is possible that at least the flange-shaped portion, preferably together with the attachment portion, can be applied as a transition profile.

As aforementioned, at least the flange-shaped portion is formed in one piece from synthetics. Preferably, the entire finishing profile is formed as a whole, for example, by producing the flange-shaped portion together with the attachment portion and the possible nose portions, for example, via extrusion. In that the finishing profile is formed in one piece from the same material, a stronger whole is obtained of the separable portions of the finishing profile, whereas, however, they are simply separable. Apart therefrom, the aforementioned holder can be formed separately, however, still as a whole as such, for example, by extrusion as well.

From the above, it is clear that for the material of the finishing profile and/or the holder preferably an extrudable material is chosen, such as synthetics or aluminum.

Examples of synthetics are synthetic materials, for example, a polymer or a copolymer, for example, polyvinyl chloride (PVC).

The finishing profile and/or the holder can also consist of or comprise an extrudable material, for example, aluminum, steel, copper and the like.

The finishing profile and/or the holder can also be realized in a variant to these materials, such as a material on the basis of wood, for example, plywood, MDF/HDF, particle board or the like.

According to a first practical example, both the finishing profile and the holder substantially consist of or comprise synthetics. Herein, the finishing profile and the holder can consist of or comprise substantially the same synthetics, for example, both of PVC, or substantially of different synthetics, for example, the finishing profile of PVC and the holder of polypropylene (PP).

According to a second practical embodiment, the finishing profile and the holder consist of or comprise different materials. So, for example, may the holder consist of synthetics, whereas the finishing profile substantially consists of or comprises aluminum, or vice versa.

The invention further comprises a finishing profile with the characteristic that the flange-shaped portion is provided for being subdivided in that the flange-shaped portion, at the location of the attachment portion, shows a portion with locally reduced wall thickness.

The portion with locally reduced wall thickness can be realized in a plurality of possible manners. So, for example, may this portion with locally reduced wall thickness be situated at the upper surface of the flange-shaped portion or at the lower surface of the flange-shaped portion. According to still another possibility, the wall thickness is locally reduced in that an internal chamber is provided in the respective portion of the wall. A combination of two or more of the aforementioned possibilities is possible as well.

Preferably, the flange-shaped portion, at the location of the attachment portion, is provided with a portion, which locally, in respect to thickness and/or composition, deviates from the global part of the flange-shaped portion, in order to facilitate the subdividing of the flange-shaped portion.

In a first preferred embodiment according to the invention, the flange-shaped portion, at the location of the attachment portion, shows a portion with locally reduced wall thickness, for example, a local wall thickness which is 10% to 90% of the global wall thickness of the flange-shaped portion, for example, 20% to 80%, such as 25% to 75%, preferably 30% to 50%.

In a variant embodiment, the flange-shaped portion, at the location of the attachment portion, shows a portion with another composition, for example, a more flexible or a less hard portion. This can be achieved by locally using another polymer, wherein preferably the finishing profile is extruded as a whole. This can also be achieved by locally adding additives, such as plasticizers, wherein also preferably the finishing profile is extruded as a whole.

The invention further comprises a finishing profile wherein the aforementioned flange-shaped portion shows a covering. Said covering comprises at least a printed thermoplastic foil.

Said covering is, for example, a layer-shaped covering whether or not matching the floor covering. This covering can be of any kind and can consist of or comprise, for example, a foil, such as a thermoplastic foil. A variant composition is, for example, a thermosetting foil, a laminate, wood or synthetics.

The aforementioned attachment portion of the finishing profile of the invention further comprises at least two attachment legs. The flange-shaped portion of the finishing profile is intended for being subdivided between the aforementioned two attachment legs. When there are more than two attachment legs, for example, four, the flange-shaped portion preferably is intended for being divided between the middlemost two attachment legs, such that the obtained profiles, in the case of an even number of attachment legs, both show an equal number of attachment legs, or that, in the case of an uneven number of attachment legs, the difference in the number of attachment legs among the obtained portions is only one.

The attachment portion, which comprises at least two attachment legs, allows subdividing the flange-shaped portion in a simple manner, providing a nice finishing and providing sufficient stability for all applications of the finishing profile.

The finishing profile of the invention further is characterized in that the finishing profile also comprises at least one nose portion, wherein this nose portion shows a surface adjoining the upper surface of the flange-shaped portion, which extends transversely to the aforementioned upper surface.

The aforementioned nose portion preferably is realized removable, for example, in that this nose portion is realized in one piece in the same material with the flange-shaped portion, however, is connected thereto via a portion, or junction portion, with locally reduced wall thickness, or in that this nose portion is realized as a separate material portion, which is connected to the flange-shaped portion, for example, at least via the aforementioned covering, and/or is connected to the flange-shaped portion at least via a mechanically locking connection, and/or is connected to the flange-shaped portion at least via a glue connection that can be broken or cut.

In a first embodiment, the nose portion is realized removable in that the nose portion is realized in one piece in the same material with the flange-shaped portion, however, is connected thereto via a portion, or junction portion, with locally reduced wall thickness, for example, a wall thickness which is 10% to 90% of the global wall thickness of the flange-shaped portion, for example, 20% to 80%, such as 25% to 75%, preferably 30% to 50%. Further, by way of example, the nose portion additionally can be connected to the flange-shaped portion via the aforementioned covering.

In a second embodiment, the nose portion is realized removable in that this nose portion is realized as a separate material portion, which is connected to the flange-shaped portion, for example, at least via the aforementioned covering.

In a third embodiment, the nose portion is realized removable in that the nose portion is connected to the flange-shaped portion at least via a mechanically locking connection.

In a fourth embodiment, the nose portion is realized removable in that this nose portion is connected to the flange-shaped portion at least via a glue connection that can be broken or cut.

In a fifth embodiment, the nose portion is realized removable by combining two or more of the above embodiments.

According to a first practical embodiment of the invention, the nose portion is realized in one piece, in the same material, with the flange-shaped portion and is connected thereto via a portion with locally reduced wall thickness, and the nose portion at the same time also additionally is connected to the flange-shaped portion via the aforementioned covering.

In respect to the first herein above-mentioned embodiment, it is noted that the geometry of the junction portion can be adapted in function of the method of removal, for example, in order to let the removal take place more smoothly. The flange-shaped portion and/or the junction portion can be provided with means which promote the removal of the respective nose portion. So, for example, the junction portion can be provided with a notch, a perforation and the like.

Also within the scope of the above-mentioned first embodiment, the junction of the nose portion to the flange-shaped portion can be situated at the location of the most distally situated portion of the lower surface of the flange-shaped portion. Preferably, however, the junction portion is situated at the location of a more proximally situated portion of said lower surface, which preferably is situated closer to the upper surface of the flange-shaped portion than the most distally situated portion of the respective lower surface. In such case, the risk is limited that possible burrs or other impurities, which may remain on the underside of the flange-shaped portion after the removal of the respective nose portion, would interfere with the good functioning of the finishing profile. In fact, the most distal portion of the lower surface can be intended for contacting, in installed condition, the floor covering which has to be finished, and any impurity or burr may lead to annoying gaps between the underside of the flange-shaped portion and the top surface of the floor.

When the finishing profile is applied as an expansion profile between two floor coverings, both nose portions are removed, such that only the flange-shaped portion and the attachment portion are used.

When the finishing profile is applied as a transition profile between two different floor coverings, one or both nose portions are removed in function of the height differences between both floor coverings. When there is, for example, a height difference, then one nose portion will be removed, such that the finishing profile obtains an inclined orientation during installation.

When the finishing profile is subdivided at the location of the attachment portion of the flange-shaped portion, then two end profiles may be created. Herein, no nose portions are removed.

According to the most preferred form, wherein the aforementioned flange-shaped portion has a covering, the latter preferably extends up to over the transition towards the at least one nose portion. Preferably, a space is provided at the location of the transition between the flange-shaped portion and the nose portion.

Preferably, the finishing profile shows at least two such nose portions, namely each time adjoining to one of the sides of the upper surface of the flange-shaped portion. In the case of a plurality of nose portions, the aforementioned covering preferably extends up to over each transition towards each nose portion. Preferably, a space is provided at the location of each transition between the flange-shaped portion and the nose portion.

According to the most preferred form, the aforementioned at least two nose profiles show a different geometry, for example, in that their respective surfaces are differently inclined in respect to the vertical.

When the most vertical nose profile is removed, then the finishing profile with the more inclined nose profile is used, for example, as a transition profile, such that a gradual alteration of the height is taking place. When the more inclined nose profile is removed, the finishing profile with the most vertical nose profile is used, for example, as an end profile, where a brisker height difference is obtained, which is ideal for using, for example, against a standing wall or skirting.

Apart from the aforementioned finishing profile, a finishing set according to the present invention also comprises a holder, which is intended for cooperating with the aforementioned attachment portion.

In a preferred embodiment, the aforementioned holder comprises at least two standing attachment legs.

The holder is intended for positioning the finishing profile in a correct manner, in that the attachment portion with the attachment legs of the finishing profile and the standing attachment legs of the holder, when positioning the finishing profile, slide into each other and thus become anchored. Preferably, the holder comprises at least three or even four standing attachment legs in order to guarantee sufficient fixation of the finishing profile in the applications wherein finishing profile and holder are subdivided, for example, the application as an end profile.

The aforementioned attachment legs of the holder and/or finishing profile can be provided with a profiled part which, for example, allows improved fixation of the finishing profile in the holder.

The holder preferably is a rail-shaped profile, which further, at least on one edge of an outermost attachment leg, has a horizontally extending portion, which is intended for attaching the holder, for example, by sliding the latter under the floor covering or by fastening it by gluing, riveting or screwing. In an embodiment which can be chosen, the holder comprises two such horizontally extending portions, one on each side of the standing attachment legs, which allow fastening the holder on both sides, or, if the holder is subdivided for certain applications, using both halves. So, for thick floor coverings, for example of 9 millimeters or more, both horizontally extending portions can be placed above each other, such that the holder will be situated higher and sufficient fixation of the finishing profile remains guaranteed.

According to a particular embodiment, the aforementioned holder of a finishing set comprises at least one groove in the upper surface thereof. Preferably, the at least one groove is made in the upper surface of the aforementioned horizontally extending portions of the holder. In a holder intended for a finishing profile with a nose portion the groove preferably is positioned such that the groove can cooperate with this nose portion, or more particularly with the underside of the respective nose portion. To this aim, the underside of the respective nose portion can be provided, for example, with a protruding portion, which can be brought into the aforementioned groove in the upper surface of the holder. This groove can result in a better attachment of the finishing profile. It is clear that the holder can be provided with two grooves, for example, in the case of a holder for a finishing profile with two nose portions, namely one groove for cooperation with each of both nose portions, more particularly with the underside of each of both nose portions. Preferably, in the cooperation between the groove and the respective nose portion a stop surface is formed, which can counteract a possible mutual rotation between the nose portion and the flange-shaped portion. This allows obtaining a stronger, better positioning of the nose portion, and the finishing profile as a whole, and moreover counteracts wear due to the thus obtained stronger positioning. In that rotation possibility is limited, it can be avoided that the nose portion is loosened from the flange-shaped portion, and/or that this nose portion performs undesired movements during usage.

It is clear that such stop surfaces can also be obtained without necessarily having to provide a groove in the holder. So, for example, may the holder comprise a standing portion, which cooperates with the underside of one of the nose portions.

It is noted that providing stop surfaces and/or support portions for nose portions of a multi-functional profile as such forms an independent inventive idea of the present invention, without the necessity to this aim that the flange-shaped portion is made dividable. These stop surfaces and/or support portions are of particular interest when thin-walled finishing profiles and/or nose portions are used, such as, for example, in the case of nose portions and profiles obtained by extrusion of synthetics, and/or when the overall height of the finishing profile must be limited, for example, to less than 10 millimeters, and/or when a flange-shaped portion is used, which, on one or more flanges, has a thickness of less than 3 millimeters and preferably less than 2 millimeters. It is clear that the present independent inventive idea can also show the characteristics of one or more of the herein above and below also mentioned preferred embodiments, without hereby necessarily having to apply a dividable flange-shaped portion.

According to another particular embodiment, which possibly can be combined with the above-mentioned, the holder is intended to cooperate with a finishing profile which shows at least one nose portion, wherein between the holder and the respective nose portion stop surfaces are formed, which counteract a possible mutual rotation between the nose portion and the flange-shaped portion. It is clear that the possible mutual rotation which is counteracted can be a rotation in only a single sense, for example with the usage surfaces of the nose portion and the flange-shaped portion towards each other, or in both senses. As abovementioned, such stop surfaces can be formed in a groove of the holder, such as intended above, or such stop surfaces can be formed on the standing sides of a standing portion of the holder. According to a variant or in combination therewith, also one or more stop surfaces can be formed on the lateral extremities of the holder. Such stop surfaces, when cooperating with a protruding portion on the underside of the respective nose portion, can counteract a rotation, wherein the usage surfaces of the nose portion and the flange-shaped portion move away from each other.

Further, the aforementioned holder is provided for being subdivided at the location of the at least two standing attachment legs. To this aim, the holder shows a portion with locally reduced wall thickness at the location of the standing attachment legs. This portion with locally reduced wall thickness can be realized in various possible manners and can be situated, for example, at the upper surface of the holder and/or at the lower surface of the holder.

The aforementioned holder, which forms part of the finishing set, at the underside mostly comprises a roughened surface or a surface with a specific relief, which allows reducing the friction between holder and underlying surface, such that the positioning of the holder is optimum, and/or which allows obtaining a better junction to the underlying surface by glue or another adhesive.

It is noted that specific cutting tools can be developed for separating the various portions of the flange-shaped portion, and the possible nose portions, of a finishing profile according to the first aspect of the invention.

Cutting tools for subdividing multi-functional finishing profiles are known as such, for example, from U.S. Pat. No. 8,109,059, wherein a cutting tool is described with exactly one knife with a fixed position in respect to a handle, and wherein the aforementioned cutting tool further also has a hook for positioning the cutting tool and accompanying the cutting. The cutting tool serves for cutting off one or both nose portions from the flange-shaped portion at the side surface. The general problem of a cutting tool of this type is that the positioning of the cutting tool on the finishing profile for a floor covering is not always performed very precisely, such that cutting can be imprecise or can be wrong.

BE 1 018 494 also describes a cutting tool for cutting a skirting board which is intended for vertical mounting against the wall, wherein the cutting tool has a knife with a fixed position in respect to a handle, and wherein said cutting tool further also has a hook for positioning the cutting tool and accompanying the cutting. The general problem of a cutting tool of this type is similar to that of the cutting tool of U.S.'059.

WO 2006/074824 shows a cutting tool which is equipped with an eyelet as a handle, or with a body. WO 2007/118999 and EP 1 841 573 both show a cutting tool with a body. The aforementioned cutting tool again comprises exactly one knife with a fixed position. This knife with fixed position serves for cutting off, at the side surface, one or both nose portions from the flange-shaped portion. The body allows placing the cutting tool in the right position on the finishing profile for a floor covering in a simple manner and performing the cutting movement precisely and smoothly, as the body slides over the surface of the finishing profile.

The cutting tool described in WO 2006/074824, WO 2007/118999 and EP 1 841 573 allows little flexibility, as the cutting tool is intended for cooperating with one certain type of finishing profile, of which one or both nose portions can be cut off with one and the same knife. Moreover, there is a risk that the wrong nose portion is cut off. In other words, such cutting tools are not user-friendly.

In view of an alternative cutting tool, which possibly could be applied, for example, with the finishing profiles of the first aspect of the invention, the invention, according to an independent second aspect, relates to a cutting tool for cutting a finishing profile for a floor covering, wherein this cutting tool comprises a body and comprises at least one knife, with the characteristic that the position of the aforementioned knife is adjustable.

In general, within the scope of the invention by adjustable is meant that the position of the knife is chosen in function of the finishing profile to be cut, for a floor covering.

In general, within the scope of the invention by a fixed position is meant that the angle over which the knife is inclined cannot be altered before, during and after the use of the cutting tool together with a finishing profile for a floor covering.

In that at least one knife is adjustable, the use of the knife can be adapted as desired by the user and/or in function of the finishing profile to be cut and in function of its application (expansion profile, transition profile or end profile).

It is clear that within the scope of the invention according to its second aspect the cutting tool comprises at last two knives. Herein, the position of one or more knives is adjustable. This is chosen in function of the finishing profile, which has to be cut, for a floor covering. This means that all knives can be adjustable, but also that one or more knives can have a fixed position. Preferably, said at least two knives comprise at least one knife with a fixed position.

The aforementioned adjustable knife is adjustable between a rest position and at least one active position. Herein, the displacement is characterized in that this displacement of the knife from the rest position to an active position comprises a displacement over a distance of 0.5 mm to 20 mm and at an inclination angle of 0° to 90° in respect to the vertical perpendicular to the surface of the cutting tool.

The surface of the cutting tool is defined as the guiding surface of the cutting tool, more particularly the guiding tool of the body of the cutting tool. This is the surface at the underside of the cutting tool.

Preferably, the aforementioned adjustable knife is attached to a resilient portion of the cutting tool, preferably of the body.

In a first embodiment, in the scope of the invention by resilient portion a portion is meant such as, for example, a resilient lip, a push-button, a slidable flap, button or lever, a rotary button, a push-and-turn button, a pinch-and-turn button, and so on. The resilient portion can be situated in one of the lateral surfaces or in the upper surface of the body of the cutting tool.

In general, in the scope of the invention by a lateral surface of the body of the cutting tool a surface is meant which is visible and which has a vertical orientation. There are at least three lateral surfaces on the body of the cutting tool.

In general, in the scope of the invention by the upper surface of the body of the cutting tool the surface is meant which is visible and which is perpendicular to the aforementioned lateral surfaces. The transition of the lateral surfaces to the upper surface can be a straight angle or a rounded angle. A rounded angle allows making the cutting tool more user-friendly in that there are no sharp edges which possibly might cause irritation at the hands, such as blisters or abrasions, during use.

When the cutting tool has more than one adjustable knife, preferably each adjustable knife is sitting on a separate resilient portion. However, it may occur that a plurality of adjustable knives is placed on one resilient portion.

When the cutting tool has more than one adjustable knife, wherein each adjustable knife is sitting on a separate resilient portion, it may occur that the at least two resilient portions are situated in the same surface, i.e. the upper surface. It may also occur that all resilient portions are situated in a separate surface, i.e. one resilient portion in a lateral surface and one resilient portion in the upper surface.

When a plurality of resilient portions is placed in the upper surface, these may be parallel, however, also perpendicular to each other or any angle there between. When the at least two portions are parallel and are situated in the upper surface, these allow cutting the flange-shaped portion, which is situated on opposite sides of an attachment portion located on the underside, such that it becomes longer or shorter, in function of the application of the finishing profile.

The use of a push-and-turn-button and a pinch-and-turn-button allows making the availability of the knife with variable position more difficult, such that a certain safety is built-in and, for example, for children laying their hands on the cutting tool, it will be more difficult to hurt themselves as it is difficult for them to use such buttons.

Optionally, prior to a first use the resilient portion can be anchored to the body of the cutting tool by a connection piece. If the resilient portion is anchored, this connection piece will be broken when the resilient portion is displaced from the rest position to an active position for the first time.

In a second embodiment, in the scope of the invention the resilient portion is displaced from the rest position to an active position by, for example, a turning movement, a push-and-click movement, a sliding movement, a turning movement, a push-and-turn movement, a pinch-and-turn movement, and so on.

In general, in the scope of the invention by a pushing movement a movement is meant wherein the reached active position is not temporarily fixed. Hereby, when using the cutting tool, the resilient portion must stay pushed-in. The resilient character of the resilient portion allows bringing the knife back into the rest position by releasing the resilient portion in order to terminate the pushing movement.

In general, in the scope of the invention by a push-and-click movement a movement is meant wherein the reached active position is temporarily or permanently fixed. Hereby, the resilient portion does not have to stay pushed in during use of the cutting tool. When temporarily fixing the active position, the resilient character of the resilient portion allows bringing the knife back into the rest position by pushing the resilient portion inward and then releasing it, such that a reversed pushing-and-clicking movement takes place. When permanently fixing the reached active position, the push-and-click movement is not reversible and the knife is definitively fixed in said active position once the resilient portion is displaced from the rest position to an active position.

In a sliding movement, turning movement, push-and-turn movement and pinch-and-turn movement, the chosen active position may or may not be temporarily or permanently fixed. If it is not temporarily or permanently fixed, it suffices to release the resilient portion after use. If the active position is temporarily fixed, after use the resilient portion is brought back to the rest position by releasing the resilient portion. If the fixed position is permanently fixed in the reached active position, the knife is definitively fixed in said active position once the resilient portion has been displaced from the rest position to an active position.

The body of the cutting tool substantially is composed of synthetic material. More particularly, this means that the body of the cutting tool substantially is composed of polymer. The polymer can be a monopolymer or a copolymer. Examples of polymers are: polypropylene, polyethylene, such as HDPE, LDPE, LLDPE, polyester, such as polyethylene terephthalate, polyamide, polyurethane, polytetrafluoroethylene (PTFE), polyvinyl chloride (PVC), polystyrene, polycarbonate, aramide, etc.

The body of the cutting tool can also be composed of different materials, such as (co)polymer, wood, composite, metal, carbon fibers, aramide, etc. Composites substantially are reinforced polymers, wherein the reinforcement is realized by, for examples, glass fibers and/or flax.

Some examples of compositions, wherein the following list is not restrictive:

- The resilient portion is a first polymer and the rest of the body is a second polymer;
- The resilient portion is a first polymer and the rest of the body is a composite, such as a glass-fiber reinforced polymer;
- The resilient portion is of metal and the rest of the body is of a polymer.

The body of the cutting tool further is characterized in that the body comprises at least one recess for a finger and/or fingertip. A recess for a finger and/or fingertip allows gripping the cutting tool easily and correctly, such that the cutting movement can be performed easily and precisely. Moreover, a recess for a finger and/or fingertip allows that the fingers neither scrape over the cut edges nor come into contact with the knives, such that user-friendliness and safety are guaranteed. A recess is situated in the vertical sides of the body of the cutting tool or in the upper surface of the body of the cutting tool.

Further, the body of the cutting tool can be characterized in that it comprises at least one opening in the upper surface, wherein said opening allows controlling the position of the aforementioned knife with fixed position. This allows that, before a cutting movement is performed and in an easy manner, it can be controlled whether the cutting tool is placed correctly and cutting will be performed at the correct nose portion or the correct nose portions. This again contributes to the user-friendliness and reduction of the risk of incorrect cutting.

The opening is made sufficiently small, such that fingers and fingertips cannot get through and contact with the knife is avoided.

In its third aspect, the invention relates to a finishing set for a floor covering, with a cutting tool according to the second aspect of the invention, characterized in that this finishing set further also comprises a finishing profile for a floor covering and a holder for a finishing profile for a floor covering according to the first aspect of the invention. The cutting tool of the finishing set is usable in an application at choice for the finishing profile: expansion profile, transition profile or end profile.

The underside of the cutting tool forms a guiding surface, which can cooperate with the aforementioned finishing profile, such that the cutting tool is presented in the correct manner to said finishing profile. In this way, it is avoided that an incorrect cut is performed, which would lead to material loss and extra costs.

The adjustable knife of the cutting tool is adjustable between, on the one side, a rest position, in which, when cooperating with said finishing profile, the adjustable knife is not in contact with said finishing profile, and, on the other hand, an active position, in which, when cooperating with said finishing profile, the adjustable knife is in contact with said finishing profile. This means that, when the knife is in the rest position, no cutting movement takes place when using the cutting tool, and that, when the knife is in an active position, a cutting movement will take place when using the cutting tool.

BRIEF DESCRIPTION OF THE DRAWINGS

With the intention of better showing the characteristics of the invention, herein below, as an example without any limitative character, some preferred embodiments are described, with reference to the accompanying, example drawings, wherein.

DETAILED DESCRIPTION

Figure 1:
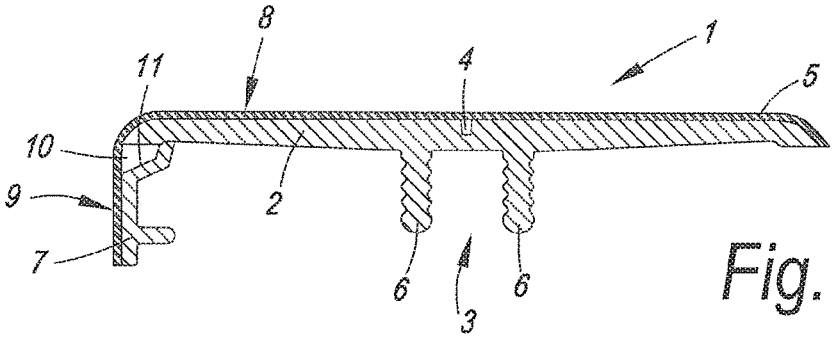
FIG. 1 represents a cross-section of a finishing profile according to the invention.

The reference numerals applied in the Figures are defined, amongst others, in the claims.

FIG. 1 shows a finishing profile for a floor covering, wherein this profile 1 comprises a flange-shaped portion 2, which extends on opposite sides of an attachment portion 3 situated at the underside. The flange-shaped portion 2 preferably is formed in one piece from synthetics and is provided for being subdivided at the location of the attachment portion 3. To this aim, the flange-shaped portion 2, at the location of the attachment portion 3, comprises a portion 4 with locally reduced wall thickness. Further, the flange-shaped portion 2 comprises a covering 5 and comprises at least two attachment legs 6. The flange-shaped portion 2 is intended for being subdivided between these two attachment legs 6.

The finishing profile 1 further also comprises a nose portion 7, wherein this nose portion 7 comprises a surface 9 adjoining the upper surface 8 of the flange-shaped portion 2, which surface 9 extends transversely to the aforementioned upper surface 8. The finishing profile 1 is characterized in that the nose portion 7 is made removable. FIG. 1 shows a removable nose portion 7, which is made in one piece from the same material as the flange-shaped portion 2 and is connected thereto via a portion with locally reduced wall thickness. Additionally, the nose portion 7 is connected to the flange-shaped portion 2 via the covering 5. The covering 5 extends up to over the transition 10 to the nose portion 7, such that at the location of the transition 10 a space 11 is provided between the flange-shaped portion 2 and the nose portion 7.

Figure 2A:
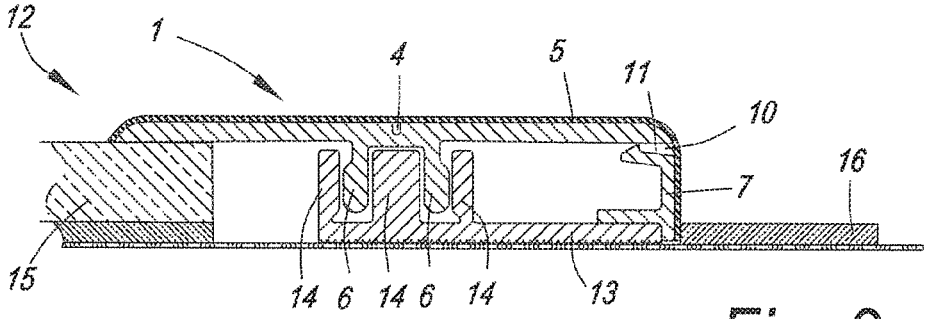
FIGS. 2*a* through 2*c* show variants of the finishing profile of FIG. 1, according to the various applications.
Figure 2B:
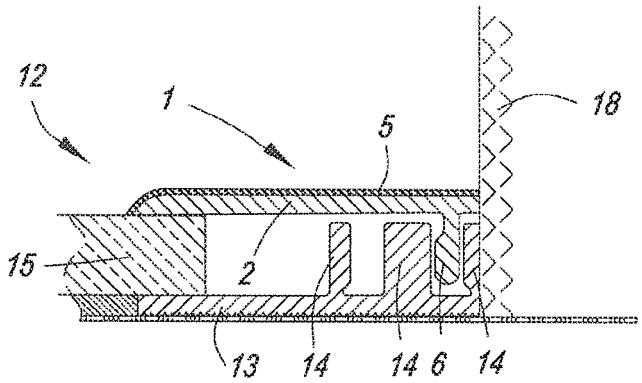
Figure 2C:
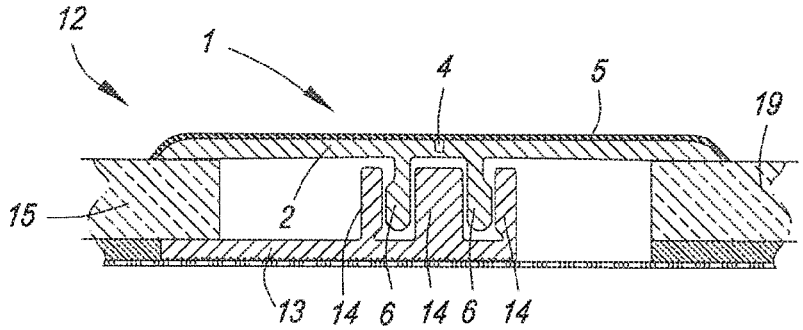

FIGS. 2*a*, 2*b* and 2*c* show the application possibilities of a finishing set 12 which, apart from a variant embodiment of the finishing profile 1 of FIG. 1, also comprises a holder 13, which is intended for cooperating with the attachment portion 3 of the finishing profile 1. To this aim, the holder 13 comprises at least two standing attachment legs 14. When using the finishing set 12, the finishing profile 1 and the holder 13 are slid into each other via the attachment legs 6 of the finishing profile 1 and the aforementioned attachment legs 14.

FIG. 2*a* shows the use of the finishing set as a transition profile between two floor coverings 15, 16 with a different height, for example, a laminate floor 15 and a carpet 16. To this aim, the nose portion 17 provides for a brisk, vertical transition in height of floor covering 15 to floor covering 16.

FIG. 2*b* shows the use of the finishing set 12 as an end profile against a wall 18. To this aim, the finishing profile 2 is divided at the height of the portion 4 with locally reduced wall thickness, such that a shortened form of the finishing profile 2 is obtained, with one attachment leg 6. The holder 13 is also divided and is slid from the one side under the floor covering 15 in order to correctly position the holder 13.

FIG. 2*c* shows the use of the finishing set 12 as an expansion profile between two floor coverings 15 and 19 of equal height. To this aim, the finishing profile 1 and the holder 13 are not cut at the height of portion 4, but only the nose portions 7 are removed. Here, the flange-shaped portion 2 comprises two attachment legs 6 and the holder 13 comprises 3 attachment legs 14.

Figure 3A:
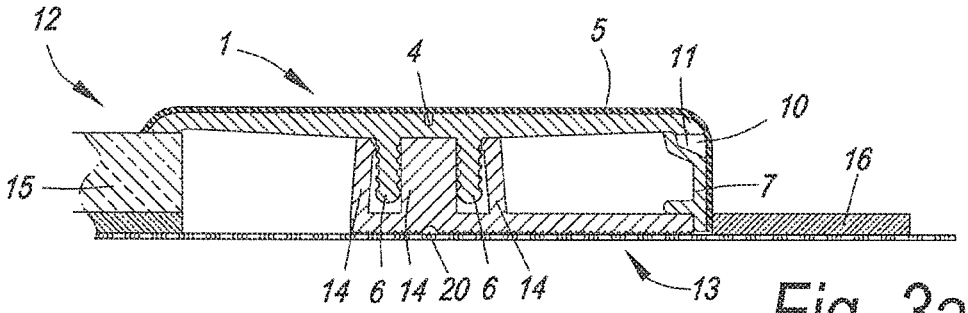
FIGS. 3*a* through 3*c* show practical embodiments of the variants of FIGS. 2*a* through 2*c* with the finishing profile of FIG. 1.
Figure 3B:
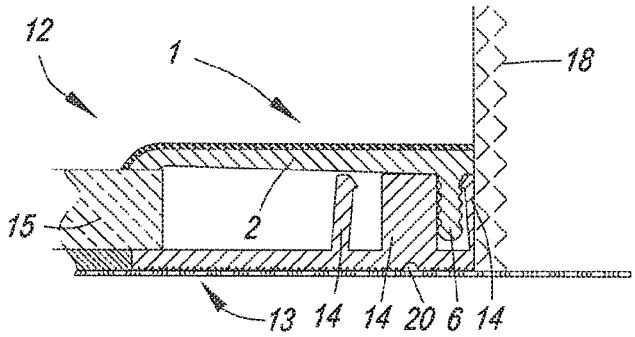
Figure 3C:
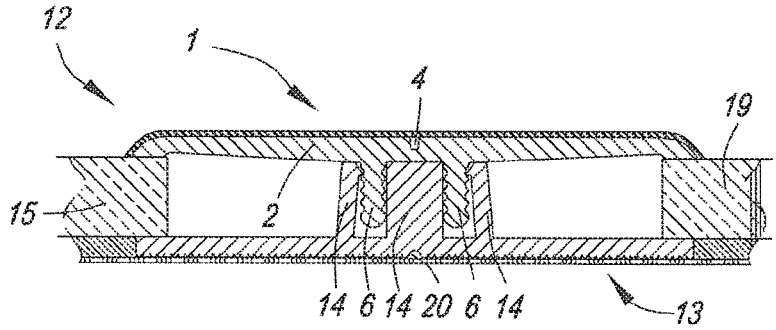

FIGS. 3*a* through 3*c* show practical embodiments of FIGS. 2*a* through 2*c*, wherein FIG. 3*a* shows the use of the finishing set as a transition profile between two floor coverings of different height 15, 16, FIG. 3*b* shows the use thereof as an end profile against a wall 18 and FIG. 3*c* shows the use thereof as an expansion profile between two floor coverings of equal height 15, 19.

The holders 13 of FIGS. 3*a* through 3*c* are provided for being divided at the location of the two standing attachment legs 14. To this aim, a portion 20 is provided with locally reduced wall thickness.

Figure 4:
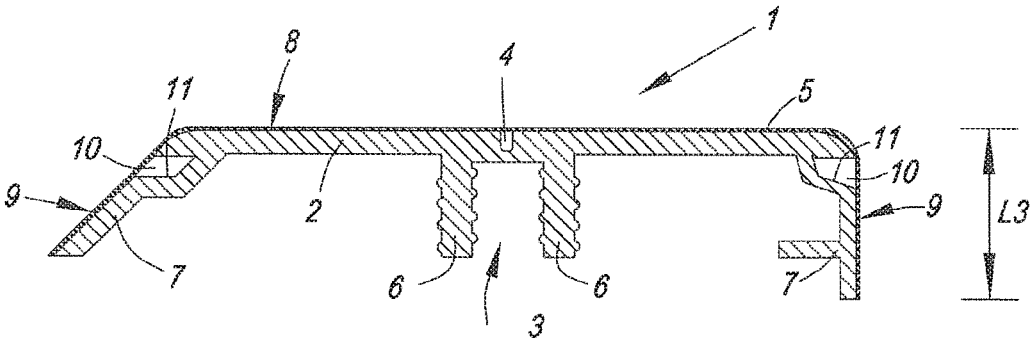
FIG. 4 shows a cross-section of a further finishing profile according to the invention.
Figure 5:
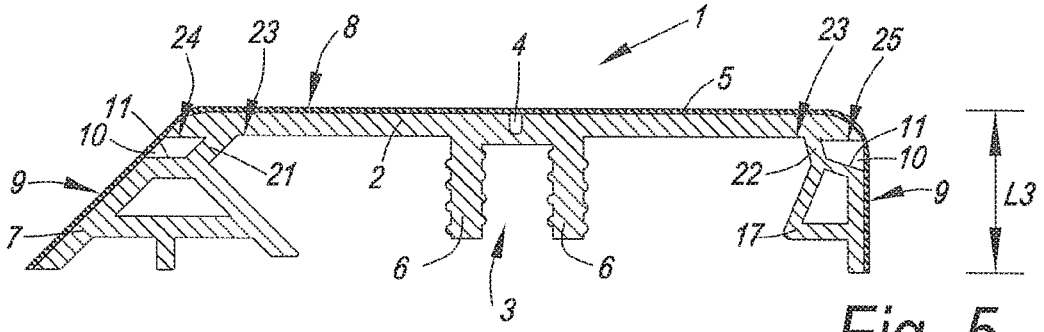
FIG. 5 shows a variant of the finishing profile of FIG. 4.

FIGS. 4 and 5 represent a variant of the finishing profile 1 of FIG. 1, wherein the finishing profile 1, apart from the flange-shaped portion 2, also comprises two nose portions 7, 17, which both adjoin to one of the edges of the upper surface 8 of the flange-shaped portion 2. The nose portions 7, 17 show a different geometry in that their respective surfaces 9 are inclined differently in respect to the vertical. Further, the flange-shaped portion 2 comprises a covering 5 and two attachment legs 6. At the location of the attachment portion 3, a portion 4 is provided with locally reduced wall thickness. This allows that the finishing profile is easy to divide there. The covering 5 extends up to over both transitions 10 to the nose portions 7, 17, wherein, in the example, at the location of these transitions 10 there is a space 11 between the flange-shaped portion 2 and the nose portion 7, 17.

The junction of the nose portions 21 to the flange-shaped portion is situated at the lower surface of the flange-shaped portion 23 and, such as here, preferably at the location of an inwardly, or more proximally, situated portion of the aforementioned lower surface 23. In this manner, it is obtained that the distal portion of the surface 24, 25 remains free from any burrs or other impurities when removing one or both nose portions 7, 17.

Figure 6:
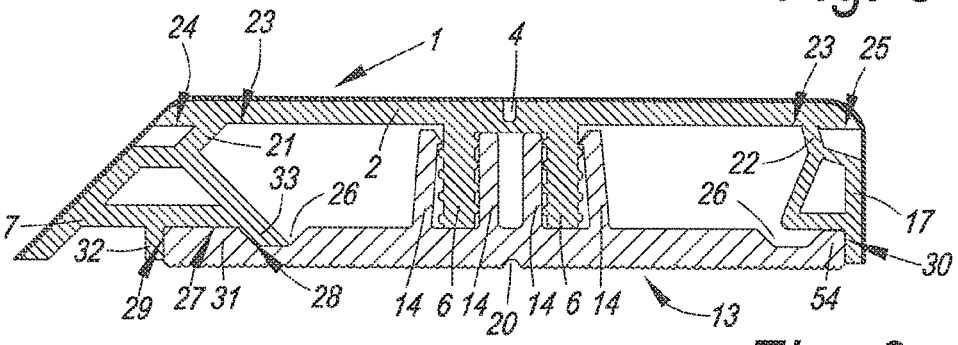
FIG. 6 shows a finishing set according to the invention.

FIG. 6 shows a finishing set according to the invention, which comprises a finishing profile 1 according to FIG. 5 and a holder 13. The holder 13 comprises two grooves 26 in its upper surface, which allow fixing the nose portions 7, 17 of the finishing profile 1. These grooves 26 lead to a better attachment of the finishing profile 1 and reduced wear in that mutual rotation between the nose portions 7, 17 and the flange-shaped portion 2 is counteracted and the nose portions 7, 17 thus cannot come loose from the flange-shaped portion 2. The holder 13 also comprises a portion 20 with reduced wall thickness, which allows dividing the holder in a simple manner between two attachment legs 14. The finishing profile 1 also comprises a portion 4 with reduced wall thickness.

It is noted that FIG. 6 also shows the characteristics of the independent inventive idea mentioned in the introduction. In this embodiment, namely, stop surfaces 27, 28 are formed between which can counteract a possible rotation between the respective nose portions and the flange-shaped portion. The respective stop surfaces 27, 28 are formed, on the one hand, in that a standing portion 31 of the holder 13, which flanks the aforementioned groove 26, cooperates with the underside of one of the nose portions, namely in this case with the underside of the nose portion 7 with the most inclined surface. The respective standing portion 31 limits the rotation of the respective nose portion 7 in both senses of rotation in that it, at the lower side of the respective nose portion 7, engages in a recess formed between two protruding portions 32, 33 thereof. On the other hand, stop surfaces 29, 30 are formed at the lateral extremities of the holder 13. This is, for example, the case with the stop surfaces between the holder 13 and the nose portion 17 with the less inclined surface. These stop surfaces 29, 30 limit the rotation of the nose portion in only one sense of rotation.

Figure 7:
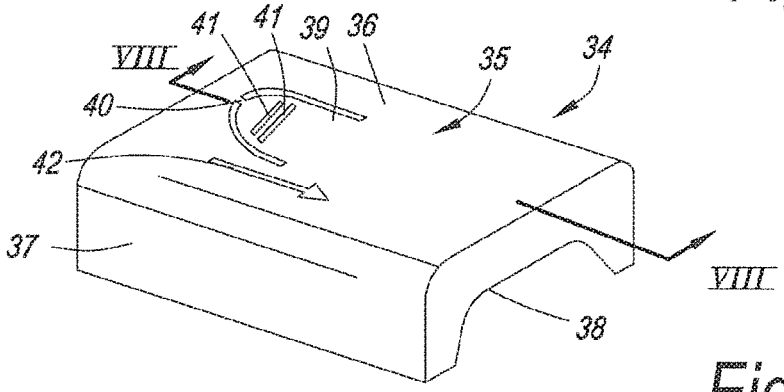
FIG. 7 shows a cutting tool according to the invention.

FIG. 7 shows a cutting tool 34 for cutting a finishing profile for a floor covering. The cutting tool 34 comprises a body 35 with an upper surface 36, four lateral surfaces 37 and a guiding surface 38. The guiding surface cooperates with the finishing profile, such that the cutting tool is placed in the right manner on the finishing profile. In its upper surface 36, the cutting tool 34 comprises a resilient portion 39, which is connected to the body via, amongst others, a connection piece 40. An adjustable knife is connected to the resilient portion via the underside. The resilient portion 39 also comprises two raised portions 41 which improve the grip of the user. Further, the cutting tool 34 also comprises an indication 42 in the form of an arrow which indicates the movement direction of the cutting tool.

Figure 8:
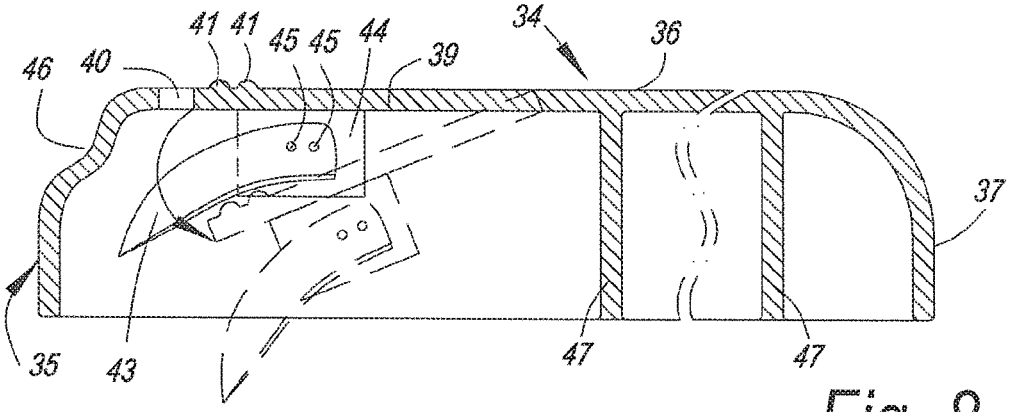
FIG. 8 shows a cross-section of a variant of the cutting tool of FIG. 7 according to the cutting line VIII-VIII indicated in FIG. 7.

FIG. 8 is a cross-section of a variant to the cutting tool of FIG. 7 according to the indicated cutting line VIII. The cutting tool 34 comprises two knives, of which the knife with fixed position is not visible in the cross-section. The adjustable knife 43 is attached onto a resilient portion 39 of the cutting tool 34, preferably of the body 35 via a fixation portion 44 by fixations 45, wherein the fixation portion 44 is attached to the resilient portion 39. The cutting tool also comprises a recess 46 for a finger and/or fingertip, and a plurality of reinforcement ribs 47. The knife 43 is adjustable between a rest position and at least one active position.

Figure 9:
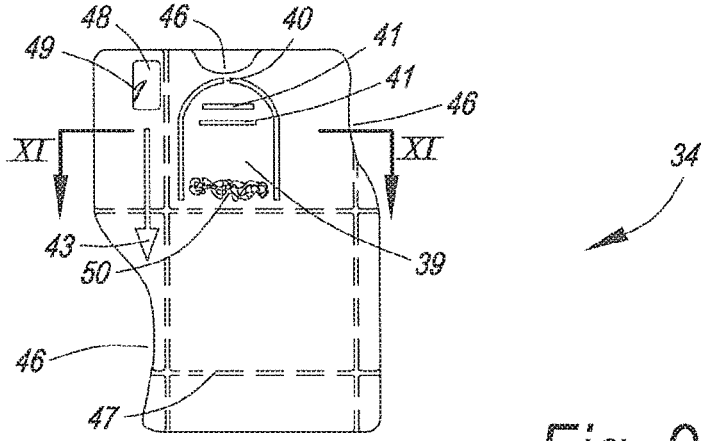
FIG. 9 shows a top view of the cutting tool of FIG. 8.

FIG. 9 shows the top view of the cutting tool 34 of FIG. 8. The adjustable knife 43 is attached from the underside to the resilient portion 39, which is situated in the upper surface 36 of the body 35. In the upper surface 36, there is also one opening 48, which allows controlling the position of the knife with fixed position 49. The cutting tool has three recesses 46 for a finger and/or fingertip and, apart from two raised portions 41 and an arrow 42 which indicates the cutting direction, also comprises an inscription 50. This inscription can be a warning or information over how the cutting tool 34 must be used.

Figure 10:
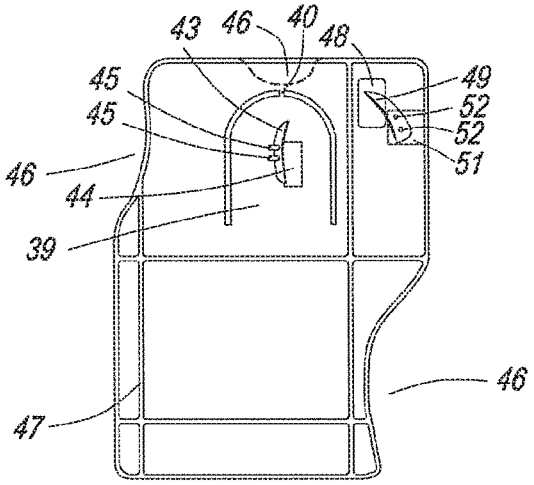
FIG. 10 shows a bottom view of the cutting tool of FIG. 8.

FIG. 10 shows the bottom view of the cutting tool 34 of FIG. 8. The adjustable knife 43 is attached, from the underside, to the resilient portion 39 via a fixation portion 44 and two fixations 45. The knife with fixed position 49 is also connected to the body 35 of the cutting tool 34 via a fixation portion 51 and two fixations 52.

Figure 11:
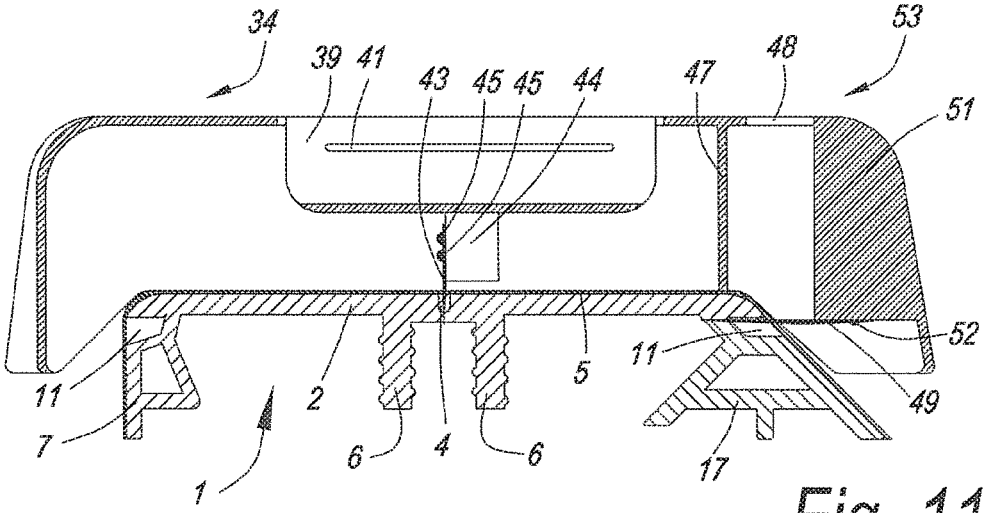
FIG. 11 shows a cutting tool in use according to a cross-section according to the cutting line XI-XI indicated in FIG. 9.

FIG. 11 shows a finishing set 53 for a floor covering with a cutting tool 34 according to FIGS. 8 to 10 and a finishing profile 1. The holder is not represented here. The cutting tool has one adjustable knife 43 which is fixed to the underside of the resilient portion 39 via a fixation portion 44 and two fixations 45. FIG. 11 shows the adjustable knife in an active position, wherein the knife 43 is sitting in the portion 4 with locally reduced wall thickness. The knife with fixed position 49 is attached onto the body 35 via fixation portion 51 and two fixations 52 and is sitting in the space 11 of the finishing profile. During use of the cutting tool, as represented in FIG. 11, the knife with fixed position 49 will cut off the nose portion 17 from the flange-shaped portion 2, and the adjustable knife 43 will cut through the flange-shaped portion 2.

Figure 12:
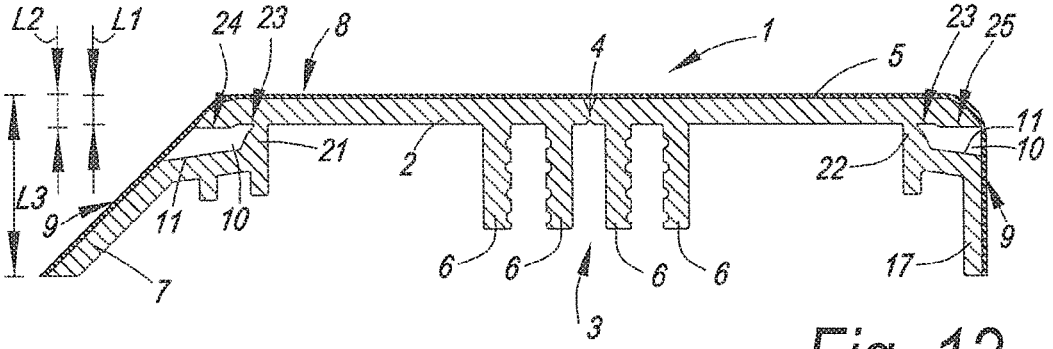
FIG. 12, in a view similar to that of FIG. 5, shows a cross-section of a further finishing profile according to the invention.

FIG. 12 shows a variant of the finishing profile 1 for a floor covering of FIG. 5. Here, too, the finishing profile 1, apart from the flange-shaped portion 2, comprises two nose portions 7, 17, which both adjoin to one of the edges of the upper surface 8 of the flange-shaped portion 2. The nose portions 7, 17 show a different geometry in that their respective surfaces 9 are inclined differently in respect to the vertical. Further, the flange-shaped portion 2 comprises a covering 5 and four attachment legs 6. At the location of the attachment portion 3, a portion with locally reduced wall thickness 4 is provided in that a recess is realized both at the upper surface and the lower surface of the flange-shaped portion. This allows that the finishing profile can easily be divided there. The covering 5 extends from on the upper surface of the flange-shaped portion 2 up to over both transitions 10 to the nose portions 7, 17, wherein at the location of these transitions 10 there is a space 11 between the flange-shaped portion 2 and the nose portion 7, 17.

The junction 21, 22 of the nose portions 7, 17 is situated at the location of an inwardly situated portion of the lower surface of the flange-shaped portion 23, which is situated closer to the upper surface 8, namely at a distance L1, than the most distal portion of the lower surface 24, 25, which namely is situated at a distance L2 to the upper surface 8 of the flange-shaped portion.

Further, the junction portion 21, 22 in this case at both nose portions 7, 17 is provided with means which promote the removal of the respective nose portion. In the example, each time a notch is provided at the location of the dividing surface to be formed.

Figure 13:
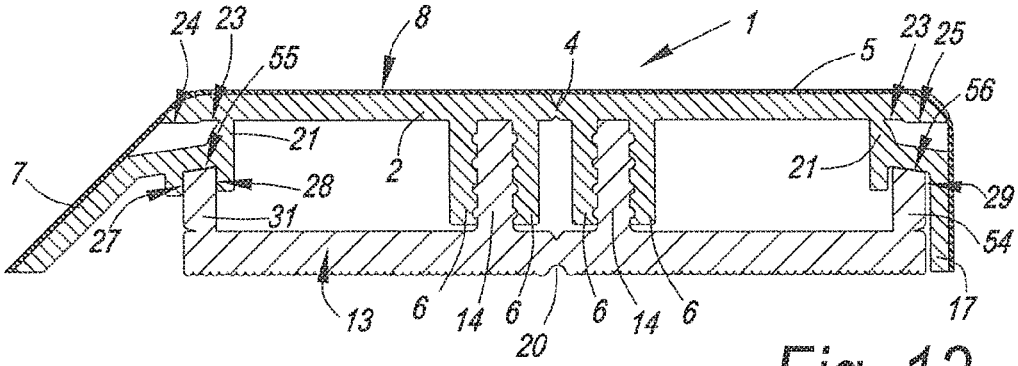
FIG. 13 shows a finishing set according to the invention with the finishing profile of FIG. 12 in a view similar to that of FIG. 6.

FIG. 13 shows a finishing set according to the invention, which comprises a finishing profile 1 according to FIG. 12 and a holder 13. The holder 13 comprises two attachment legs 14, which cooperate with the four attachment legs 6 of the finishing profile, wherein these slide into each other and this position can be fixated thanks to the profiled portions of both attachment legs 14 of the holder 13. The holder 13 comprises standing portions 31, 54, which cooperate with the underside of the nose portions 7, 17 of the finishing profile 1. In this cooperation, stop surfaces 27, 28, 29 are created, which limit the rotation of the respective nose portions in both senses of rotation. Moreover, in the present example vertically operating support portions 55, 56 are formed in that the respective standing portions 31, 54 are or can come into contact with the underside of the respective nose portion 7, 17. The standing portions 31, 54 of the holder are realized removable and have a notch which allows smooth removal, for example, via cutting, tearing or folding. The removal of one or more support portions is useful in the cases wherein the horizontally extending portions of the holder have to be provided underneath a floor covering, such as it is the case, for example, when it would be used in an application similar to that of FIG. 3*a*, 3*b* or 3*c*.

Figure 14:
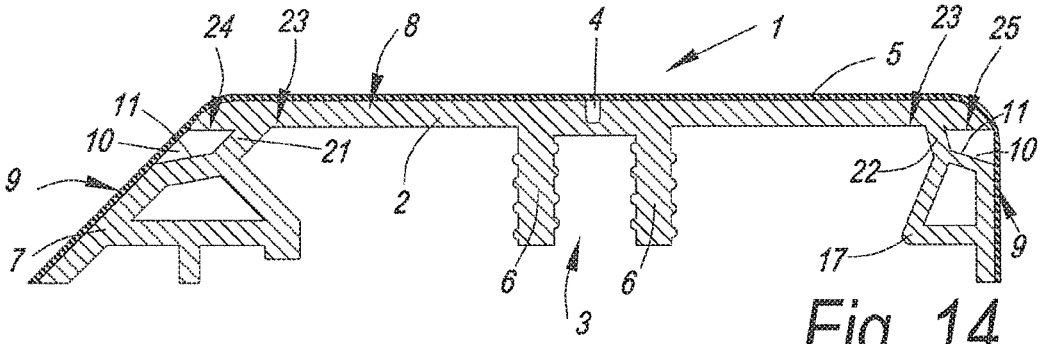
FIG. 14, in a view similar to that of FIG. 5, shows a cross-section of a further finishing profile according to the invention.
Figure 15:
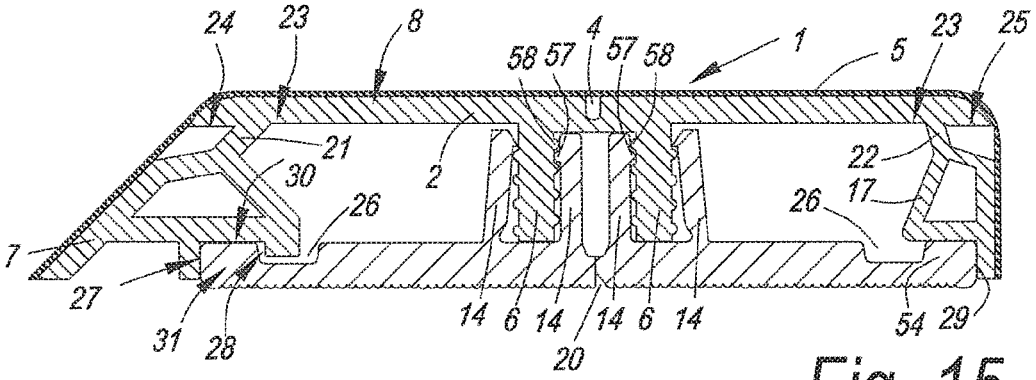
FIG. 15 shows a finishing set according to the invention with the finishing profile of FIG. 14 in a view similar to that of FIG. 6.

FIG. 14 shows another variant of the finishing profile 1 of FIG. 5. FIG. 15 shows a finishing set with the finishing profile of FIG. 14 and a holder 13. Herein, the geometry of the middlemost attachment legs of the holder is provided with a protrusion 57, which can cooperate with the profiled portion of the attachment legs of the flange-shaped portion 58. Further, there are also some changes in the structure of the nose portions, which can lead to a stronger whole which also is simpler to extrude. So, for example, an inclined wall is introduced at the upper side of nose portion 7. The grooves 26 at the upper side of the holder 14, too, now comprise walls which are more vertically inclined, which can limit the limitation of the rotation of the respective nose portion more strongly.

In connection with the examples from the figures, it is also noted that the aforementioned nose portions 7, 17 and/or the aforementioned flange-shaped portion 2 can be obtained by extrusion. The overall height L3 of the finishing profile preferably is less than 10 millimeters. The aforementioned flange-shaped portion shows, on one or both flanges, preferably a thickness L2 of less than 3 millimeters and preferably less than 2 millimeters.

The present invention is in no way limited to the embodiments described by way of example and represented in the figures, on the contrary can such finishing sets, finishing profiles and cutting tools be realized according to various variants, without leaving the scope of the invention.

The present invention further relates to various preferred embodiments, as defined in the numbered items below:

1. Finishing profile for a floor covering, wherein this profile (1) comprises at least a flange-shaped portion (2), which extends on opposite sides of an attachment portion (3) situated on the underside, wherein the flange-shaped portion (2) is formed in one piece from synthetics and is provided for being subdivided at the location of the attachment portion (3).

2. Finishing profile according to item 1, wherein the flange-shaped portion (2) is provided for being subdivided in that the flange-shaped portion (2), at the location of the attachment portion (3), shows a portion (4) with locally reduced wall thickness.

3. Finishing profile according to item 1 or 2, wherein the aforementioned flange-shaped portion (2) shows a covering (5).

4. Finishing profile according to item 3, wherein the aforementioned covering (5) comprises at least a printed thermoplastic foil.

5. Finishing profile according to any of the preceding items, wherein the aforementioned attachment portion (3) comprises at least two attachment legs (6).

6. Finishing profile according to item 4 or 5, wherein the flange-shaped portion (2) is intended for being subdivided between the aforementioned two attachment legs (6).

7. Finishing profile according to any of the preceding items, wherein the attachment profile (1) further also comprises at least one nose portion (7), wherein this nose portion (7) shows a surface (9) adjoining to the upper surface (8) of the aforementioned flange-shaped portion (2), which surface extends transversely to the aforementioned upper surface (8).

8. Finishing profile according to item 6 or 7, wherein the aforementioned nose portion (7) is made removable, for example, in that this nose portion (7) is made in one piece, from the same material, with the aforementioned flange-shaped portion (2), however, is connected thereto by a portion with locally reduced wall thickness, or in that this nose portion is realized as a separate material portion, which is connected to the flange-shaped portion (2), for example, at least via the aforementioned covering (5), and/or is connected to the flange-shaped portion (2) at least via a mechanically locking connection, and/or is connected to the flange-shaped portion (2) at least via a glue connection that can be broken or cut.

9. Finishing profile according to item 8, wherein the aforementioned flange-shaped portion (2) shows a covering (5), which extends up to over the transition (10) between the flange-shaped portion (2) and the nose portion (7) towards the aforementioned nose portion (7).

10. Finishing profile according to item 8 or 9, wherein a space (11) is provided at the location of the transition (10) between the flange-shaped portion (2) and the nose portion (7).

11. Finishing profile according to any of the items 7 to 10, wherein the finishing profile shows at least two of such nose portions (7, 17), namely each time adjoining to one of the edges of the upper surface (8) of the flange-shaped portion (2).

12. Finishing profile according to item 11, wherein the aforementioned nose portions (7, 17) show a different geometry, for example, in that their respective surfaces (9) are differently inclined in respect to the vertical.

13. Finishing set with a finishing profile according to any of the preceding items, wherein this finishing set (12) further also comprises a holder (13), which is intended for cooperating with the aforementioned attachment portion (3).

14. Finishing set according to item 13, wherein the aforementioned holder (13) comprises at least two standing attachment legs (14).

15. Finishing set according to item 13 or 14, wherein the aforementioned holder (13) comprises at least one groove (26) in the upper surface.

16. Finishing set according to item 14 or 15, wherein the aforementioned holder (13) is provided for being subdivided at the location of the at least two standing attachment legs (14).

17. Finishing set according to item 16, wherein the holder (13) is provided for being divided in that the holder (13), at the location of the standing attachment legs (14), comprises a portion (20) with locally reduced wall thickness.

18. Finishing set for a floor covering, whether or not according to any of the items 13 to 17, wherein the aforementioned finishing set comprises a finishing profile (1) and a holder (13), wherein the aforementioned finishing profile (1) comprises at least a flange-shaped portion (2), which extends on opposite sides of an attachment portion (3) situated on the underside and comprises at least one nose portion (7), wherein this nose portion (7) comprises a surface (9) adjoining to the upper surface (8) of the aforementioned flange-shaped portion (2) and extending transverse to the aforementioned upper surface (8), wherein the aforementioned nose portion (7) is made removable, wherein the aforementioned holder (13) comprises at least a standing portion (31) which can cooperate with the underside of the aforementioned nose portion, such that stop surfaces (27, 28) are created, which limit a possible rotation of the nose portion (2) in respect to the flange-shaped portion (2).

19. Finishing set according to item 18, wherein the aforementioned nose portion (7) and/or the aforementioned flange-shaped portion (2) is obtained by extrusion and/or that the overall height (L3) of the finishing profile (1) is less than 10 millimeters and/or that the aforementioned flange-shaped portion (2), on one or both flanges, shows a thickness (L2) of less than 3 millimeters and preferably less than 2 millimeters.

20. Cutting tool for cutting up a finishing profile for a floor covering, wherein this cutting tool (34) comprises a body (35) and comprises at least one knife (43), wherein the position of the aforementioned knife (43) is adjustable.

21. Cutting tool according to item 20, wherein the cutting tool comprises at least two knives (43, 49).

22. Cutting tool according to item 21, wherein the aforementioned at least two knives (43, 49) comprise at least one knife with a fixed position (49).

23. Cutting tool according to any of items 20 to 22, wherein the aforementioned adjustable knife (43) is adjustable between a rest position and at least one active position.

24. Cutting tool according to item 23, wherein the displacement of the knife from the rest position to an active position is a displacement over a distance of 0.5 mm to 20 mm and at an inclination angle of 0° to 90° in respect to the vertical perpendicular to the surface of the cutting tool.

25. Cutting tool according to any of items 20 to 24, wherein the aforementioned adjustable knife (43) is attached to a resilient portion (39) of the cutting tool (34), preferably of the body (35).

26. Cutting tool according to any of items 20 to 25, wherein the body is composed substantially of synthetic material.

27. Cutting tool according to any of items 20 to 26, wherein the body (35) is provided with at least one recess for a finger and/or fingertip (46).

28. Cutting tool according to item 22, wherein the body (35) comprises at least one opening (48) in the upper surface (36), wherein the aforementioned opening (48) allows controlling the position of the aforementioned knife with fixed position (49).

29. Finishing set for a floor covering with a cutting tool according to any of the items 20 to 28, wherein this finishing set further also comprises a finishing profile for a floor covering and a holder for a finishing profile for a floor covering.

30. Finishing set according to item 29, wherein the cutting tool is usable in an application at choice for the finishing profile: expansion profile, transition profile or end profile.

31. Finishing set according to any of the items 29 to 30, wherein the underside of the cutting tool forms a guiding surface (38) which can cooperate with the aforementioned finishing profile, such that the cutting tool is presented on the aforementioned finishing profile in the right manner.

32. Finishing set according to any of the items 29 to 31, wherein the aforementioned adjustable knife (43) is adjustable between, on the one hand, a rest position in which, when cooperating with the aforementioned finishing profile, the adjustable knife is not in contact with the aforementioned finishing profile, and, on the other hand, an active position in which, when cooperating with the aforementioned finishing profile, the adjustable knife is in contact with the aforementioned finishing profile.

The invention claimed is:

1. A finishing set comprising:

a finishing profile comprising:

at least one flange-shaped portion;

an attachment portion that is located on an underside of the flange-shaped portion and comprises two attachment legs;

at least one nose portion that is formed in a single piece with a same material of the flange-shaped portion; and a junction portion that forms a connection between the nose portion and the flange-shaped portion, has a locally-reduced wall thickness and is on a lower surface of the flange-shaped portion, and comprises a surface that adjoins to an upper surface of the flange-shaped portion and extends transversely to the upper surface of the flange-shaped portion;

wherein the flange-shaped portion extends on opposite sides of the attachment portion;

wherein the nose portion is removable from the flange-shaped portion via the connection between the nose portion and the flange-shaped portion formed by the junction portion; and wherein the flange-shaped portion is formed in one piece from synthetics and is configured for being subdivided at a location of the attachment portion; and a holder for cooperating with the attachment portion, the holder comprising four attachment legs that are configured for cooperating with the two attachment legs of the finishing profile.

2. The finishing set of claim 1, wherein the flange-shaped portion is configured for being subdivided wherein the flange-shaped portion, at the location of the attachment portion, comprises a portion with locally reduced wall thickness.

3. The finishing set of claim 1, wherein the flange-shaped portion comprises a covering, wherein the covering comprises at least a printed thermoplastic foil.

4. The finishing set of claim 1, wherein the flange-shaped portion comprises a covering, which extends up to over a transition between the flange-shaped portion and the nose portion towards the nose portion.

5. The finishing set of claim 4, wherein a space is provided at a location of the transition between the flange-shaped portion and the nose portion.

6. The finishing set of claim 1, wherein the at least one nose portion is at least two nose portions, each of which is adjoined to a respective edge of the upper surface of the flange-shaped portion.

7. The finishing set of claim 6, wherein each nose portion comprises a different geometry, such that a respective surface of each nose portion is differently inclined in respect to vertical.

8. The finishing set of claim 1, wherein:

the holder is configured for being subdivided at a location of the two attachment legs and comprises, at the location of the two attachment legs, a portion with locally reduced wall thickness;

the finishing profile is formed in one piece from synthetics; and the holder is formed in one piece from synthetics.

9. The finishing set of claim 8, wherein the holder comprises at least one groove in the upper surface.

10. The finishing set of claim 8, wherein the holder comprises at least a standing portion, which is configured to cooperate with an underside of the nose portion, such that stop surfaces are created that limit a possible rotation of the nose portion in respect to the flange-shaped portion.

11. The finishing set of claim 8, comprising a cutting tool for cutting up a finishing profile for a floor covering, wherein the cutting tool comprises a body and at least one knife, wherein a position of the knife is adjustable.

12. The finishing set of claim 11, wherein the cutting tool comprises at least two knives, wherein the at least two knives comprise at least one knife with a fixed position.

13. The finishing set of claim 12, wherein the body comprises at least one opening in an upper surface, wherein the opening allows controlling position of the knife with fixed position.

14. The finishing set of claim 11, wherein the adjustable knife is attached to a resilient portion of the cutting tool, of the body.

15. The finishing set of claim 11, wherein the body comprises at least one recess for a finger and/or fingertip.

16. The finishing set of claim 11, wherein the cutting tool is configured for use in an application at choice for the finishing profile: expansion profile, transition profile, or end profile.

17. The finishing set of claim 11, wherein the underside of the cutting tool forms a guiding surface which can cooperate with the finishing profile, such that the cutting tool is presented on the finishing profile in a right manner.

18. The finishing set of claim 11, wherein the adjustable knife is adjustable between a rest position in which, when cooperating with the finishing profile, the adjustable knife is not in contact with the finishing profile, and, an active position in which, when cooperating with the finishing profile, the adjustable knife is in contact with the finishing profile.

19. The finishing set of claim 1, wherein:

the at least one nose portion comprises at least two nose portions, each of which comprises a surface that adjoins to a respective edge of an upper surface of the flange-shaped portion, extends transversely to the upper surface, and is removable; and each nose portion of the at least two nose portions comprises a different geometry, such that a respective surface of each nose portion is differently inclined in respect to vertical.

20. The finishing set of claim 1, wherein a geometry of the junction portion comprises a notch or perforation, which is configured such that the nose portion is removable from the flange-shaped portion via cutting, tearing, or folding.

21. A finishing set comprising:

a finishing profile comprising:

at least one flange-shaped portion;

an attachment portion that is located on an underside of the flange-shaped portion and comprises four attachment legs;

at least one nose portion that is formed in a single piece with a same material of the flange-shaped portion; and a junction portion that forms a connection between the nose portion and the flange-shaped portion, has a locally-reduced wall thickness and is on a lower surface of the flange-shaped portion, and comprises a surface that adjoins to an upper surface of the flange-shaped portion and extends transversely to the upper surface of the flange-shaped portion;

wherein the flange-shaped portion extends on opposite sides of the attachment portion;

wherein the nose portion is removable from the flange-shaped portion via the connection between the nose portion and the flange-shaped portion formed by the junction portion; and wherein the flange-shaped portion is formed in one piece from synthetics and is configured for being subdivided at a location of the attachment portion; and a holder for cooperating with the attachment portion, the holder comprising two attachment legs that are configured for cooperating with the four attachment legs of the finishing profile.

22. The finishing set of claim 21, wherein:

the holder is configured for being subdivided at a location of the four attachment legs and comprises, at the location of the four attachment legs, a portion with locally reduced wall thickness;

the finishing profile is formed in one piece from synthetics; and the holder is formed in one piece from synthetics.

* * * * *